US005224369A

United States Patent [19]

Rehag et al.

[11] Patent Number: 5,224,369

[45] Date of Patent: Jul. 6, 1993

[54] COLD PILGER ROLLING MILL WITH RECIPROCATING ROLL STAND

[75] Inventors: Klaus Rehag, Monchen-Gladbach; Josef Gerretz, Viersen, both of Fed. Rep. of Germany

[73] Assignee: Mannesmann Aktiengesellschaft, Dusseldorf, Fed. Rep. of Germany

[21] Appl. No.: 917,176

[22] Filed: Jul. 20, 1992

[30] Foreign Application Priority Data

Jul. 22, 1991 [DE] Fed. Rep. of Germany ..... 4124691

[51] Int. Cl.[5] ..... B21B 21/00

[52] U.S. Cl. ..... 72/214; 72/249; 74/591

[58] Field of Search ..... 72/208, 209, 214, 249; 74/62, 591

[56] References Cited

U.S. PATENT DOCUMENTS 4,052,898 10/1977 Miller et al. ..... 72/249

4,386,512 6/1983 Rehag et al. ..... 72/249

*Primary Examiner*—Lowell A. Larson

*Assistant Examiner*—Thomas C. Schoeffler

*Attorney, Agent, or Firm*—Cohen, Pontani, Lieberman & Pavane

[57] ABSTRACT

A cold pilger rolling mill includes a reciprocating roll stand and a crank drive connected to the roll stand through connecting rods. The crank drive includes three shafts arranged parallel to each other and spaced apart at equal distances. The middle shaft is a crank shaft connected through crank pins with the connecting rod. A main weight for balancing half of the inertia forces of the roll stand is arranged eccentrically relative to the axis of rotation on the crank of the crank pin offset by 180° from the pivot point of the connecting rod. On the two other shafts are arranged two additional weights of equal size which balance the other half of the inertia forces of the roll stand. For a synchronous rotation of the shafts and their weights, the shafts are connected by spur gears meshing with each other in such a manner that the additional weights rotate in opposite directions to the main weight with the same rate of rotation and, at the dead centers of the roll stand, the sum of the main weight and the additional weights acting on the roll stand corresponds to the inertia forces of the roll stand and of any other weights moved with the roll stand.

5 Claims, 5 Drawing Sheets

COLD PILGER ROLLING MILL WITH RECIPROCATING ROLL STAND

BACKGROUND OF THE INVENTION

1. Field of the Invention

The present invention relates to a cold pilger rolling mill with a reciprocating roll stand, wherein the inertia forces of the mill stand can be balanced or compensated by counterweights which are arranged eccentrically on a crank drive which is connected to the roll stand through connecting rods.

2. Description of the Related Art

Federal Republic of Germany AS 18 15 521 discloses a pilger step-by-step-type rolling mill including a roll stand which is reciprocated in a horizontal plane. The connecting rods which drive the roll stand are pivoted to two crank means which are driven synchronously in opposition so as to provide an equalization of the inertia forces produced by the swinging masses of the roll stand in a plane extending through the axis of the material being rolled.

For a complete balancing of the inertia forces caused by the swinging masses of the roll stand in all planes extending through the axis of the material being rolled, the state of the art utilizes complementary weights which are fastened eccentrically on the two crank means, so that their projections onto the plane of movement of the roll stand shift at each moment of a complete operating cycle, opposite to the movement of the roll stand. In this way, a solution is offered for the problem inherent in the pilger step-by-step rolling process with reciprocating roll stand, namely that reciprocating parts which weigh many tons cause inertia forces which result in considerable mechanical problems.

For the desired complete balancing of the inertia forces, the previously known solution requires two connecting rods, which represent a considerable structural expense. Since the gears for the coupling of the shafts which are necessary for the balancing of the inertia force must transmit the entire power for the movement of the roll stand, two of each must be provided, so that the expense for bearings is also increased and a stable housing construction becomes very expensive. In addition, it is necessary to adapt to each other the two connecting cranks which are arranged parallel to each other in order to compensate deviations in the kinematic dimensions resulting from manufacture.

SUMMARY OF THE INVENTION

Therefore, it is the object of the present invention to provide a crank drive of a cold pilger rolling mill with rotating mass equalizing weights which is of simple combination and easily assembled and in which the amount of space required is reduced and expensive foundations are avoided.

In accordance with the present invention, the crank drive includes three shafts arranged parallel to each other and spaced apart at equal distances. The middle shaft is a crank shaft connected through crank pins with the connecting rod which is connected to the roll stand. On the crank of the crank pin, offset by 180° from the pivot point of the connecting rod, is arranged eccentrically to the axis of rotation of the crank shaft a main weight which balances half of the inertia forces of the roll stand, and on the two other shafts are arranged two additional weights of equal size which balance the other half of the inertia forces of the roll stand. For a synchronous rotation of the shafts and their weights, the shafts are connected by spur gears meshing with each other in such a manner that the additional weights rotate in opposite directions to the main weight with the same rate of rotation, and that, at the dead centers of the roll stand, the sum of the main weight and the additional weights on the roll stand corresponds to the inertia forces of the roll stand and of any other weights moved with the roll stand.

The invention provides the result that the inertia forces of first order are completely balanced at the dead centers of the roll stand. In the 90° and 270° positions, in which no stand inertia forces occur, the rotating weights themselves balance each other. All intermediate positions are also completely balanced.

In accordance with another favorable feature of the invention, for the balancing of inertia forces of the second order, two additional weights of the same size which rotate with twice the speed and in opposite directions are provided on shafts which extend parallel to the other shafts and mesh through spur gears with one of the spur gears which drive the additional weights.

By providing rotating weights which have twice the speed of rotation, it is possible also to balance inertia forces of the second order. The additionally provided weights are half as large as the additional weights which represent a quarter of the total weight if the distance of the center of gravity of the additional weights from the corresponding axes of rotation is equal to the crank radius.

In accordance with a further favorable structural development of the invention, the shafts of the main weight and the additional weights are arranged one behind the other in the direction of movement of the roll stand. This arrangement provides the advantage that units arranged on the crank housing are more easily accessible.

In accordance with further developments of the invention, the shafts can be arranged both vertically or horizontally while still providing the advantages of the invention.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DESCRIPTION OF THE PREFERRED EMBODIMENTS

Figure 1:
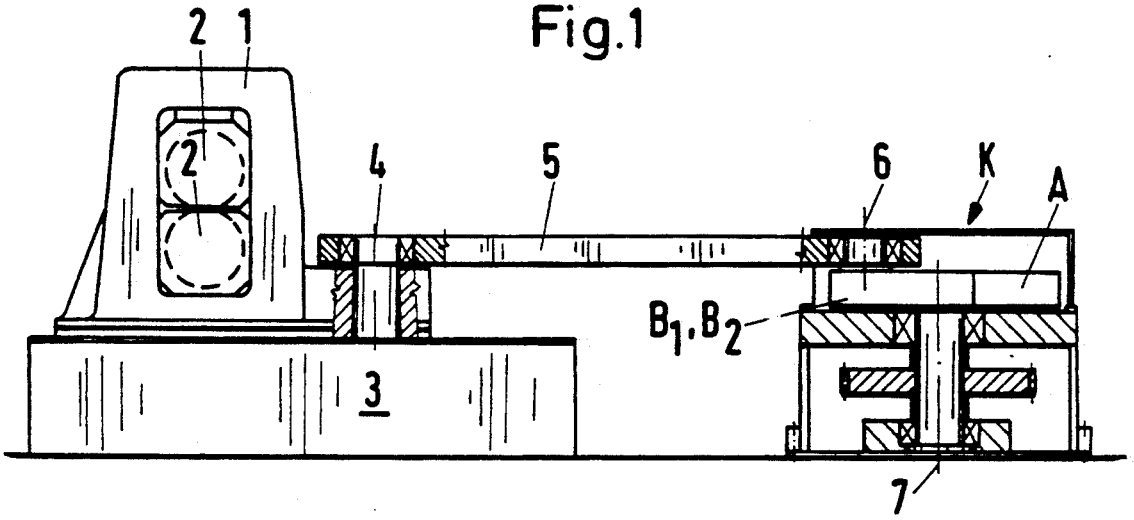
FIG. 1 is an elevational view of a cold pilger rolling mill according to the present invention.

In FIG. 1 of the drawing, reference numeral 1 denotes a roll stand of a cold pilger rolling mill. The roll stand includes pilger rolls 2. The roll stand 1 is movable back and forth on a frame 3 by means of a connecting rod 5 which is pivoted at one end at 4 on the roll stand and at the other end eccentrically on the crank drive at 6. The crank drive K is driven by a drive motor, not shown.

The inertia forces of the entire roll stand are balanced by counterweights A, B1 and B2 which are arranged eccentrically on the crank drive K. The crank drive rotates about vertical axes.

Figure 2:
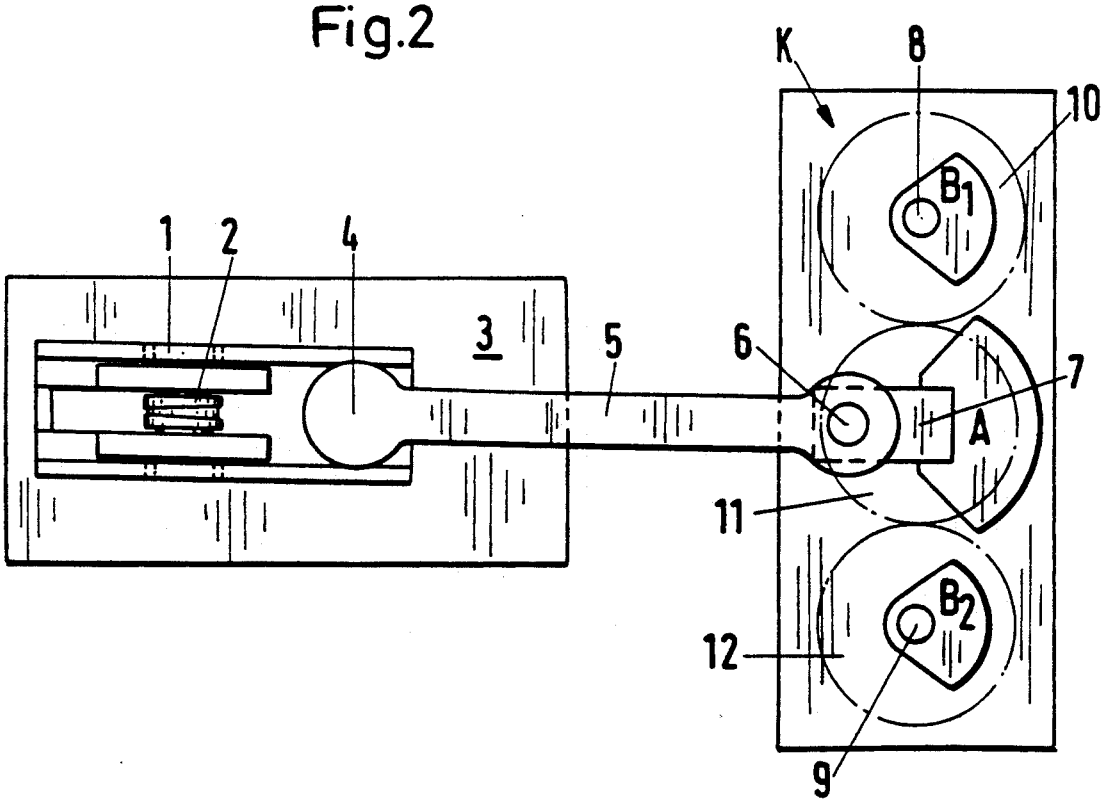
FIG. 2 is a top view of the cold pilger rolling mill of FIG. 1.

FIG. 2 is a top view of the cold pilger rolling mill of FIG. 1. The middle shaft 7 of the crank drive K is a crank shaft. The connecting rod 5 is connected at 6 to the crank pins of the crank shaft. The counterweight A is offset by 180° relative to pivot point 6 of the connecting rod 5. The weight of the counterweight A is such that it balances half of the inertia force of the roll stand.

Extending parallel to and on both sides of the shaft 7 are shafts 8 and 9 on which additional weights B1 and B2 of equal size are arranged. The additional weights B1 and B2 balance the other half of the inertia forces of the roll stand 1. The synchronous rotation of the shafts 7, 8, 9 is ensured by spur gears 10, 11, 12, which mesh with each other and are arranged on the shafts 7, 8, 9. The additional weights B1, B2 rotate at the same speed but in a direction opposite that of the main weight A. The additional weights are arranged such that, at the dead centers of the roll stand, the sum of the main weight and additional weights A+B1+B2 acting on the roll stand corresponds to the inertia forces of the roll stand and any other weights moved with the roll stand.

Figure 3:
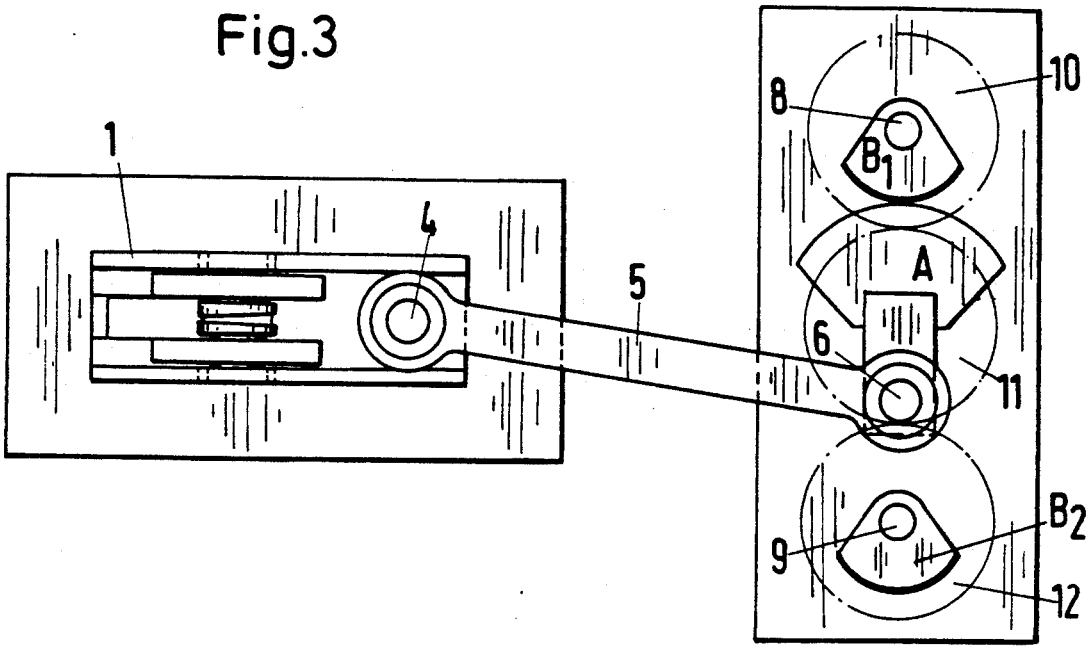
FIGS. 3 and 4 are top views, similar to FIG. 2, of the cold pilger rolling mill of FIG. 1 showing two different positions of the connecting crank.

FIG. 3 shows the same cold pilger rolling mill as FIGS. 1 and 2 but in the 90-degree position of the roll stand and crank drive. In this position, there are no inertia forces from the stand because the rotating masses counterbalance each other.

Figure 4:
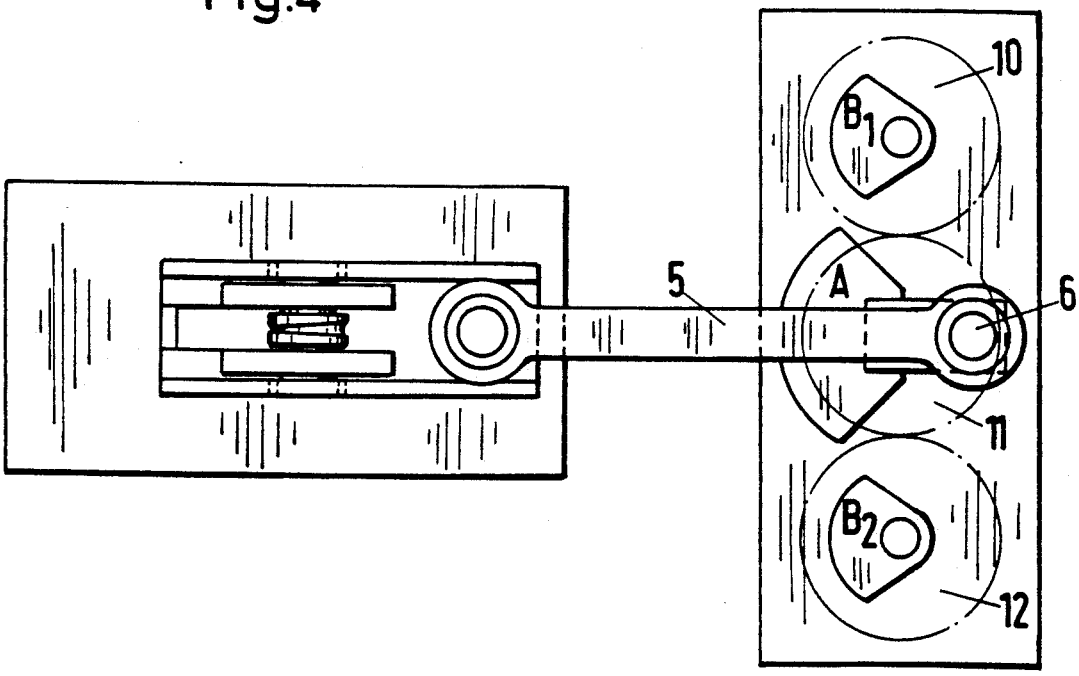

FIG. 4 shows the position of the cold pilger rolling mill and crank drive in the 180° position; in this position, the counterweights A, B1 and B2 again completely balance the inertia force, as in the position shown in FIG. 2.

Figure 5:
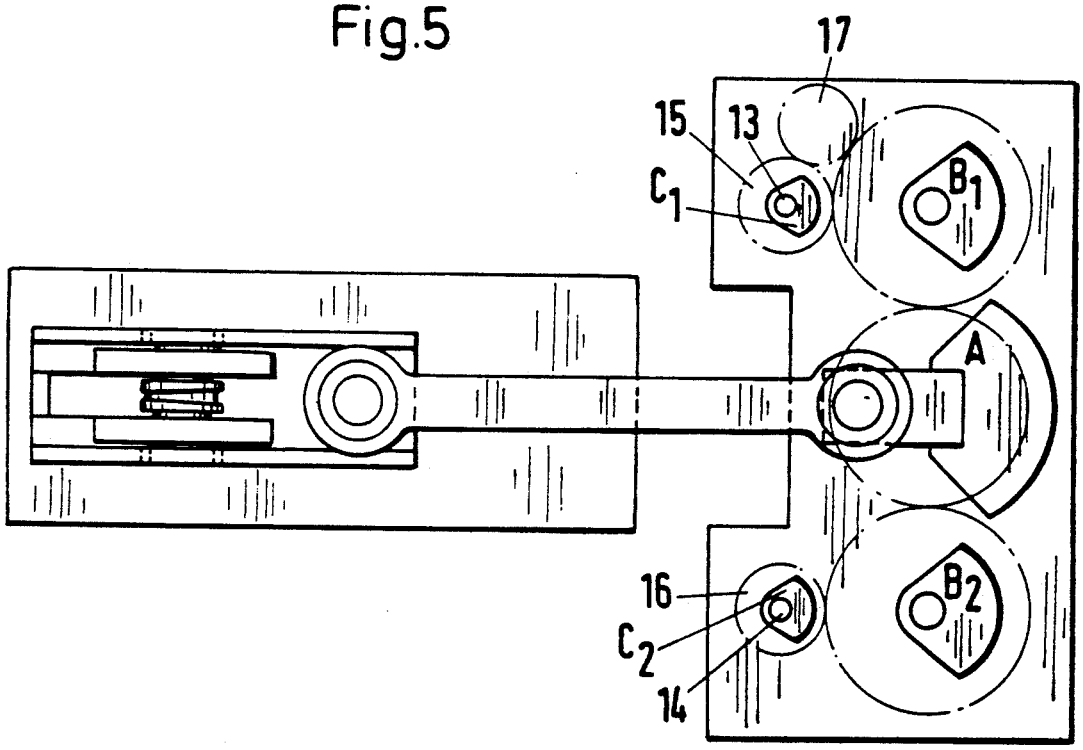
FIG. 5 is a top view of a cold pilger rolling mill according to the present invention with additional weights.

In the top view of FIG. 5, a cold pilger rolling mill is shown in zero position in which the inertia forces of the second order are also balanced out. In addition to the additional weights B1 and B2, there are two further rotating weights C1 and C2 which are a shaft 13, 14 which extend parallel to the shafts 7, 8, 9. The further weights C1 and C2 rotate at twice the rate of the weights A, B1 and B2 and are placed in movement by spur gears 15, 16 in such a manner that the directions of rotation of the weights C1 and C2 are opposite each other. For this purpose, a spur gear 16 which drives the weight C2 meshes directly with the spur gear 12 of the additional weight B2. A spur gear 15 driving the weight C1 meshes with an intermediate gear 17, which reverses the direction of rotation and meshes with the spur gear 10 which moves the additional weight B1.

Figure 6:
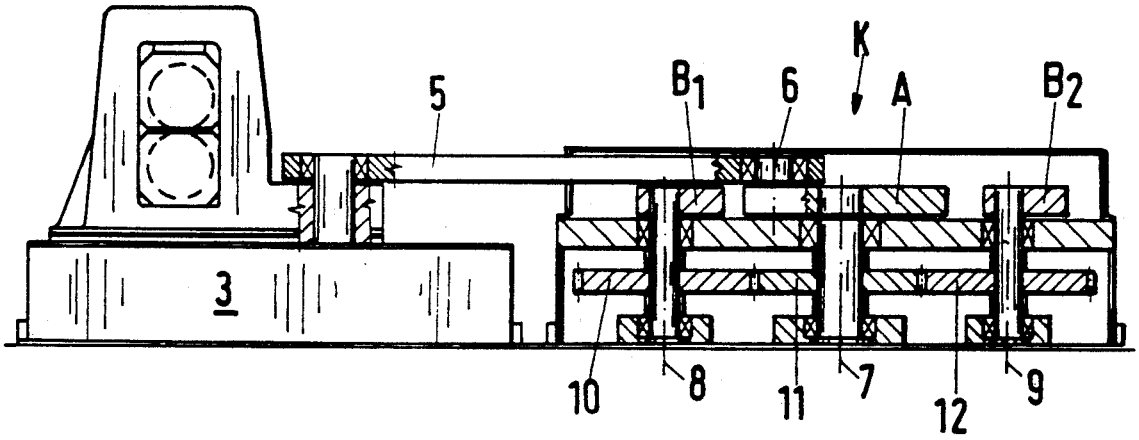
FIG. 6 is an elevational view of a cold pilger rolling mill according to the present invention in which the shafts are arranged one behind the other.
Figure 7:
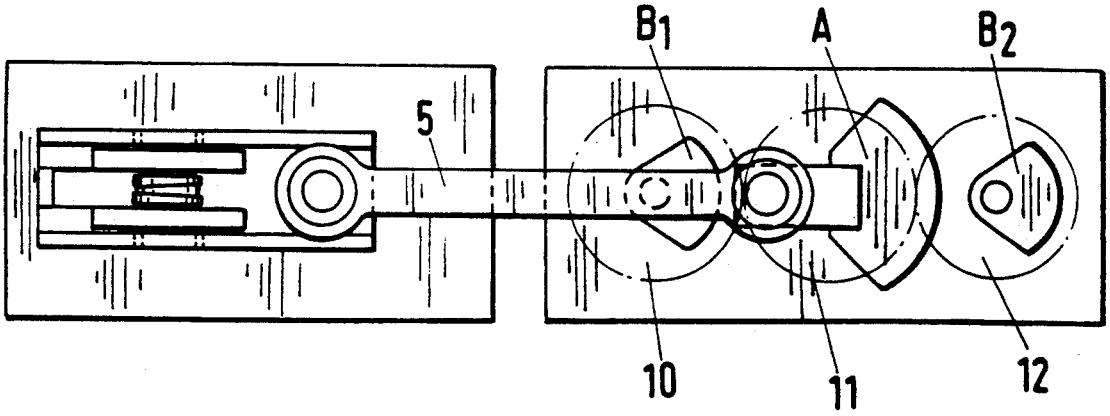
FIG. 7 is a top view of a cold pilger rolling mill in zero position corresponding to FIG. 6.

A particularly advantageous development of the cold pilger rolling mill of the invention is shown diagrammatically in FIG. 6. Identical parts are provided with the same reference numerals. In this example, as can also be seen in FIG. 7 which is a top view of the cold pilger rolling mill of FIG. 6, the crank and equalization shafts are arranged one behind the other in the direction of rolling. As a result of this solution, the units arranged on the housing of the crank drive K are easily accessible.

Figure 8:
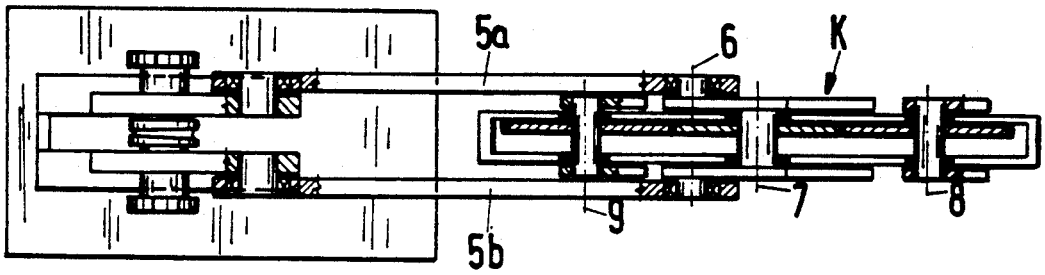
FIG. 8 is a top view of a cold pilger rolling mill with horizontally arranged crank and equalization shafts.
Figure 9:
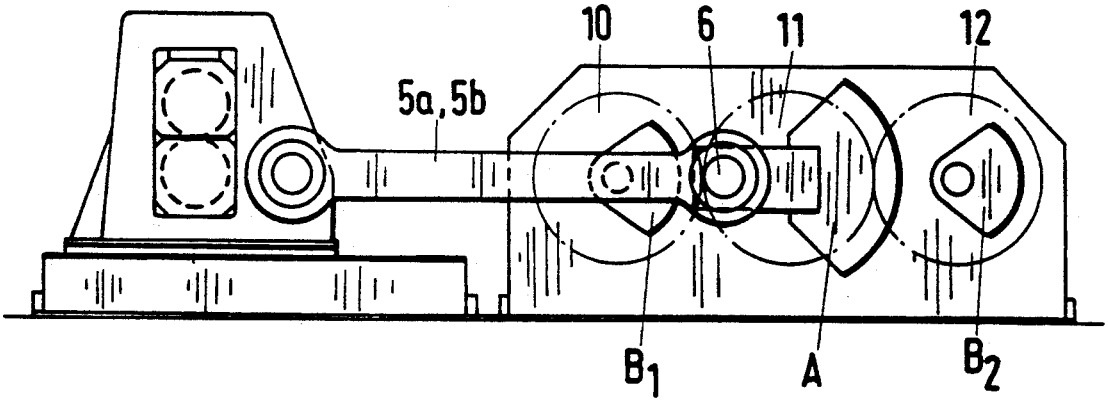
FIG. 9 is an elevational view of the cold pilger rolling mill of FIG. 8.

Another advantageous further development of the invention is shown in the top and front views of FIGS. 8 and 9. In this case, differing from the solutions described above, two connecting rods 5*a*, 5*b* are pivoted on the two sides of the crank drive K. This development of the invention provides the same advantages of the invention.

It should be understood that the preferred embodiments and examples described are for illustrative purposes only and are not to be construed as limiting the scope of the present invention which is properly delineated only in the appended claims.

We claim:

1. A cold pilger rolling mill, comprising:

a roll stand;

a crank drive for reciprocating the roll stand on a horizontal plane in a direction of movement between dead center positions;

the crank drive comprising three parallel shafts including a middle shaft and two additional shafts equally spaced from the middle shaft, each shaft having an axis of rotation;

the middle shaft being a crank shaft having a crank pin and a crank;

at least one connecting rod connected to the roll stand and to the crank pin in a pivot point;

the crank drive comprising counterweights for balancing inertia forces of the roll stand;

the counterweights comprising a main weight mounted on the crank of the middle shaft eccentrically relative to the axis of rotation of the middle shaft and offset by 180° relative to the pivot point, the main weight being selected such that the main weight balances half of the inertia forces of the roll stand, and an additional weight each being mounted on each additional shaft eccentrically relative to the axis of rotation thereof, the two additional weights on the two additional shafts being selected such that the additional weights balance another half of the inertia forces of the roll stand;

each shaft having a spur gear, wherein the spur gears of the additional shafts mesh with the spur gear of the middle shaft for obtaining a synchronous rotation of the shafts and the counterweights thereof, such that in operation of the rolling mill the additional weights rotate in opposite direction of the main weight at equal rates of rotation and, in the dead center positions of the roll stand, forces exerted by the counterweights through the connecting rod on the roll stand correspond to the inertia forces of the roll stand and any further weights moved with the roll stand.

2. The cold pilger rolling mill according to claim 1, comprising two further weights for balancing inertia forces of the second order, the two further weights being mounted on further shafts extending parallel to the shafts of the crank drive, each further shaft having a spur gear, the spur gear of one further shaft meshing with the spur gear of one of the additional shafts, an additional gear meshing with the spur gear of the other of the additional shafts, the spur gear of the other of the further shafts meshing with the additional gear, so that the further shafts rotate in opposite directions, the spur gears of the further shafts being of equal size and selected such that the further shafts rotate at twice the rate of rotation of the shafts of the crank drive.

3. The cold pilger rolling mill according to claim 1, wherein the shafts of the crank drive are arranged one behind the other in the direction of movement of the roll stand.

4. The cold pilger rolling mill according to claim 1, wherein the shafts of the crank drive are arranged vertically.

5. The cold pilger rolling mill according to claim 1, wherein the shafts of the crank drive are arranged horizontally.

* * * * *